US011517906B2

(12) United States Patent
Sawant et al.

(10) Patent No.: US 11,517,906 B2
(45) Date of Patent: Dec. 6, 2022

(54) MODULAR STAND APPARATUS FOR LAB EXPERIMENTATION

(71) Applicants: Ashish Sawant, Palm Beach Gardens, FL (US); Reji N. Nair, Los Angeles, CA (US)

(72) Inventors: Ashish Sawant, Palm Beach Gardens, FL (US); Reji N. Nair, Los Angeles, CA (US)

( * ) Notice: Subject to any disclaimer, the term of this patent is extended or adjusted under 35 U.S.C. 154(b) by 208 days.

(21) Appl. No.: 16/862,381

(22) Filed: Apr. 29, 2020

(65) Prior Publication Data

US 2020/0346219 A1 Nov. 5, 2020

Related U.S. Application Data

(63) Continuation-in-part of application No. 29/732,740, filed on Apr. 27, 2020, now Pat. No. Des. 949,508.

(60) Provisional application No. 62/840,919, filed on Apr. 30, 2019.

(51) Int. Cl.
*B01L 9/04* (2006.01)
*B01L 9/00* (2006.01)

(52) U.S. Cl.
CPC ..... *B01L 9/00* (2013.01); *B01L 2200/028* (2013.01)

(58) Field of Classification Search
CPC ..... B01L 9/04
See application file for complete search history.

(56) References Cited

U.S. PATENT DOCUMENTS

| | | | | |
|---|---|---|---|---|
| 3,623,707 | A | 11/1971 | Klopp | |
| 3,782,713 | A | 1/1974 | Yount | |
| 4,637,323 | A * | 1/1987 | Nicely | A47B 57/26 108/147.14 |
| 7,820,115 | B2 | 10/2010 | Zatechka et al. | |
| 8,740,191 | B2 | 6/2014 | Litcher | |
| 2008/0156759 | A1* | 7/2008 | Lai | A47B 47/0083 211/187 |
| 2011/0079620 | A1* | 4/2011 | Todorovic | B60R 9/00 29/428 |

OTHER PUBLICATIONS

"Swiss Boy Lab Jacks", https://www.sigmaaldrich.com/catalog/product/aldrich/z635316?lang=en&region=US.
"Laboratory Aids, Laboratory Jacks—Aluminum Base or All Stainless Steel", https://www.rosesci.com/Products/products.php?search_go=Jacks,%20laboratory.

* cited by examiner

*Primary Examiner* — Paul S Hyun

(57) ABSTRACT

A modular stand apparatus offers safe and effective setup of laboratory experiments. The apparatus allows a user to couple vertical rods to a first plate. A second plate, parallel to the first plate and vertically translating up and down the vertical rods, permits the user of any height to utilize the apparatus and the placement of an extraneous rigging such as jack, scale, etc. A plurality of horizontal rods including hypotenuse and adjacent rods detachably couples with the vertical rods and permits the placement of extraneous rigging. The horizontal rods replace monkey bars in conventional systems so that the user does not have to lean or stretch hands/arms inside a fume hood, thus eliminating potential unsafe operations and/or physical injuries. Due to the use of a larger and more stable surface of the second plate over the extraneous rigging, the apparatus eliminates possible toppling over and/or system collapsing.

10 Claims, 11 Drawing Sheets

MODULAR STAND APPARATUS FOR LAB EXPERIMENTATION

The current application claims a priority to the U.S. Provisional Patent application Ser. No. 62/840,919 filed on Apr. 30, 2019.

FIELD OF THE INVENTION

The present invention relates generally to laboratory equipment. More specifically, the present invention relates to a stand apparatus that incorporates a modular construction about a first basal plate alongside a vertically translating plate. The modular stand apparatus provides efficient and effective setup for laboratory experiments to a user of any height.

BACKGROUND OF THE INVENTION

Presently, manipulatable stands are constrained to a highly constrained form conventionally in execution such as those for chemistry, material analysis and similar. There is a distinct lack in a stand assembly that facilitates modular construction of an upper cage that is conducive to precision-based projects or experiments where the user may alter the dimensions of the equipment relatively consequent to their particular personal dimensions. This presents a void wherein a lab or environment of work must generally provide multiple stands for various individuals or provides additional means for various individuals to employ a single stand.

To carry out laboratory experiments such as chemical reactions, most existing assemblies include normal devices such as clams, round bottom flasks with stir bars, oil bath for heating, magnetic stirs/hot plates, laboratory scissor jacks for adjusting the height of the reaction assembly, etc. The clamps are fixed to the monkey bars, which in-turn hold the neck of the round bottom flask placed in the oil bath for heating. The magnetic stir/hot plate controls the heating temperature of the oil bath and also keeps oil as well as reaction mixture stirring. To have all these components set up correctly, the jack is used to hold the assembly at a certain height such that when reaction (heating) needs to be stopped, only the jack needs to be lowered and the reaction flask, which is immersed in oil bath is no longer in contact with the hot oil. This conventional system, however, presents the following drawbacks. Firstly, the monkey bars are normally located at two feet or more distance inside a fume hood, which creates a problem for a user who is short in stature as the user often cannot reach the monkey bars easily and has to stretch far or even lean inside the fume hood to fix clamps on the monkey bars. Secondly, the stretching makes the user painful/tiring and often results in clamps that are not well secured on first attempt. Thirdly, leaning inside the fume hood is against safety policies as the user is likely to breathe in organic vapors or be exposed to other chemicals.

Another common problem with most existing systems is the mismatch assembly of hot plates and lab jacks. Magnetic stir/hot plates have been evolving over the years and their sizes have changed depending on the design. These hot plates are circular, square and rectangular plates that possess a side-bar to hold sensors as well as act as a clamp holder. Lab Jacks also come in varying sizes. The hazardous nature of this assembly is that magnetic stir/hot plates often do not situate on the jack base in proper alignment. Often, the four supports of the hot plate are outside of the jack platform causing the base of the hot plate in direct contact with the jack platform. This is not desirable as it is not a part of the design of the hot plate and it also blocks the vents underneath the hot plate. The lack of proper contact makes the assembly significantly vulnerable to be easily toppled over with accidental bump. If the reaction system is still hot, this setup can be dangerous and cause burns if the system spills directly on the user. Further, if the jack platform is small in size and supporting an assembly with a large footprint, the center of gravity of the assembly shifts as the height increases, and thus making the assembly more vulnerable to be toppled over and/or collapse with an slight accidental bump. In this type of setup, the entire assembly has no steady support of any kind and will topple completely.

Thus, it is an objective of the present invention to provide an efficient and effective solution to the above-mentioned drawbacks and problems in the field of laboratory experimental systems. The modular stand apparatus of the present invention offers a design and construction that allows the user to safely assemble and conduct laboratory experiments such as chemical reactions.

SUMMARY OF THE INVENTION

An innovative stand apparatus offers a user modular construction and simple design for safely and effectively setting up laboratory experiments. The modular stand apparatus allows the user to couple at least two vertical rods of a plurality of rods to a first plate which serves as the base platform of the system. A second plate, configured to be parallel to the first plate, may vertically translate up and down the plurality of vertical rods. Thus, through a first and second plate, the modular stand apparatus is capable of translating relative to the first plate and permits the user of any height to utilize the stand apparatus. Additionally, the translating nature of the second plate relative to the first permits the placement of an extraneous jack, scale, or any other element of lab/work equipment. Further, the modular stand apparatus introduces a plurality of horizontal rods that couples with the plurality of vertical rods using a plurality of clamps. The user may modularly impart a hypotenuse rod that permits the placement of extraneous rigging and equipment over the center of the second plate. Additionally, the user may modularly impart at least one adjacent rod that accommodates extraneous rigging or equipment about a lateral edge of the stand. Thus, the modular stand apparatus allows the user to set up a laboratory experiment by setting up equipment through the plurality of horizontal and vertical rods in place of monkey bars which may require the user to lean or stretch hands/arms inside the fume hood, thus eliminating potential unsafe operations and/or physical injuries. Since any extraneous rigging such as a jack, scale, etc., works with a larger and more stable surface through the second plate, the modular stand apparatus eliminates or significantly reduces the possibility of hot plate toppling over and/or system collapsing than a conventional system. Thus, the modular stand apparatus presents a safe and efficient system employable by multiple users of various disciplines through a plurality of rods, clamps, and plates to enact a stand assembly therefrom.

DETAIL DESCRIPTIONS OF THE INVENTION

Figure 1:
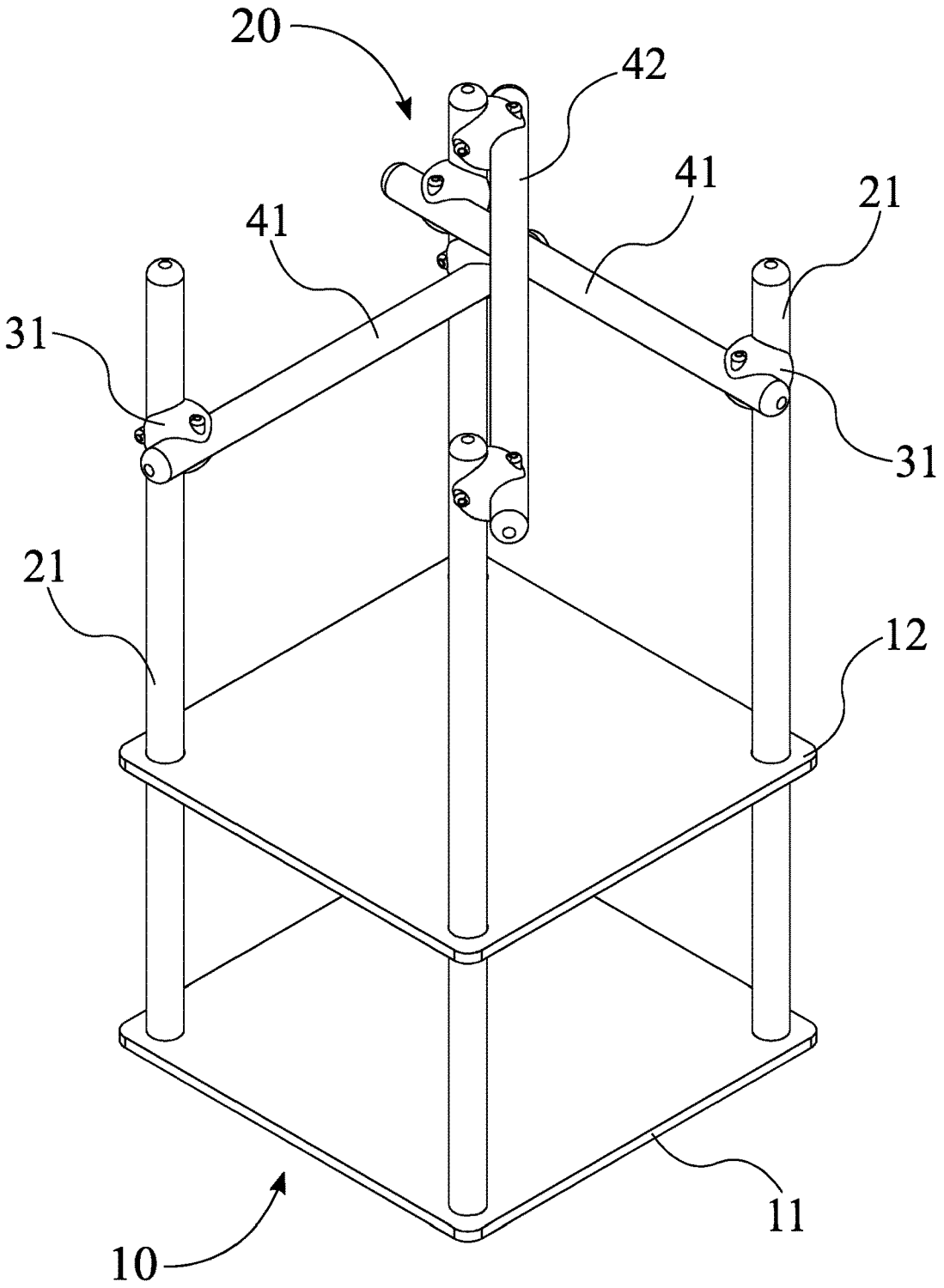
FIG. 1 is a perspective view of the present invention, where the plurality of vertical rods is observed passing through the second plate and planting at the first plate thereunder. Further observed is the plurality of clamps coupled to the plurality of vertical rods.

All illustrations of the drawings are for the purpose of describing selected versions of the present invention and are not intended to limit the scope of the present invention.

The present invention introduces a stand assembly that is modular in construction and provides a flexible and stable frame to a user to efficiently and effectively set up activities, which may include, but are not limited to, laboratory experiments, chemical reactions, chemical and/or physical tests, etc. Such a frame system may be called and/or similar to a "Monkey Bar" assembly. With the present invention, the user may couple at least two vertical elements to a first plate base plate. A second support plate, parallel to the first, may vertically translate up and down the vertical elements. Thus, through the first and second plates, capable of translating relative to the first plate, the present invention permits the user of any height to utilize the stand assembly. Additionally, the translating nature of the second plate relative to the first permits the placement of a jack, scale, or other element of lab/work equipment. Further, the present invention introduces a plurality of horizontal elements that couples with a plurality of clamps. The user may modularly impart a hypotenuse element that allows the placement of extraneous rigging and equipment over the center of the second plate. Further, the user may modularly and horizontally impart at least one adjacent element that accommodates extraneous rigging or equipment about a lateral edge of the stand assembly of the present invention.

As can be seen in FIG. 1 to FIG. 11, the present invention comprises a modular stand apparatus that provides effective and efficient setup for laboratory experiments and tests to the user regardless of the height of the user. The stand apparatus comprises a plurality of plates 10 and a plurality of rods 20. The plurality of plates 10 comprises a first plate 11, a second plate 12, and at least one additional plate 14. The plurality of rods 20 comprises a plurality of vertical rods 21, a plurality of clamps 31, and a plurality of horizontal rods 41. The plurality of vertical rods 21 is terminally mounted to the first plate 11 of the plurality of plates 10 and positioned perpendicular to the first plate 11. Each of the plurality of horizontal rods 41 is detachably attached to the plurality of vertical rods through the plurality of clamps 31 and positioned perpendicular to the plurality of vertical rods 21 opposite the first plate 11. Additionally, the second plate 12 is movably attached to at least one of the plurality of vertical rods 21 between the first plate 11 and the plurality of horizontal plates 41.

Figure 2:
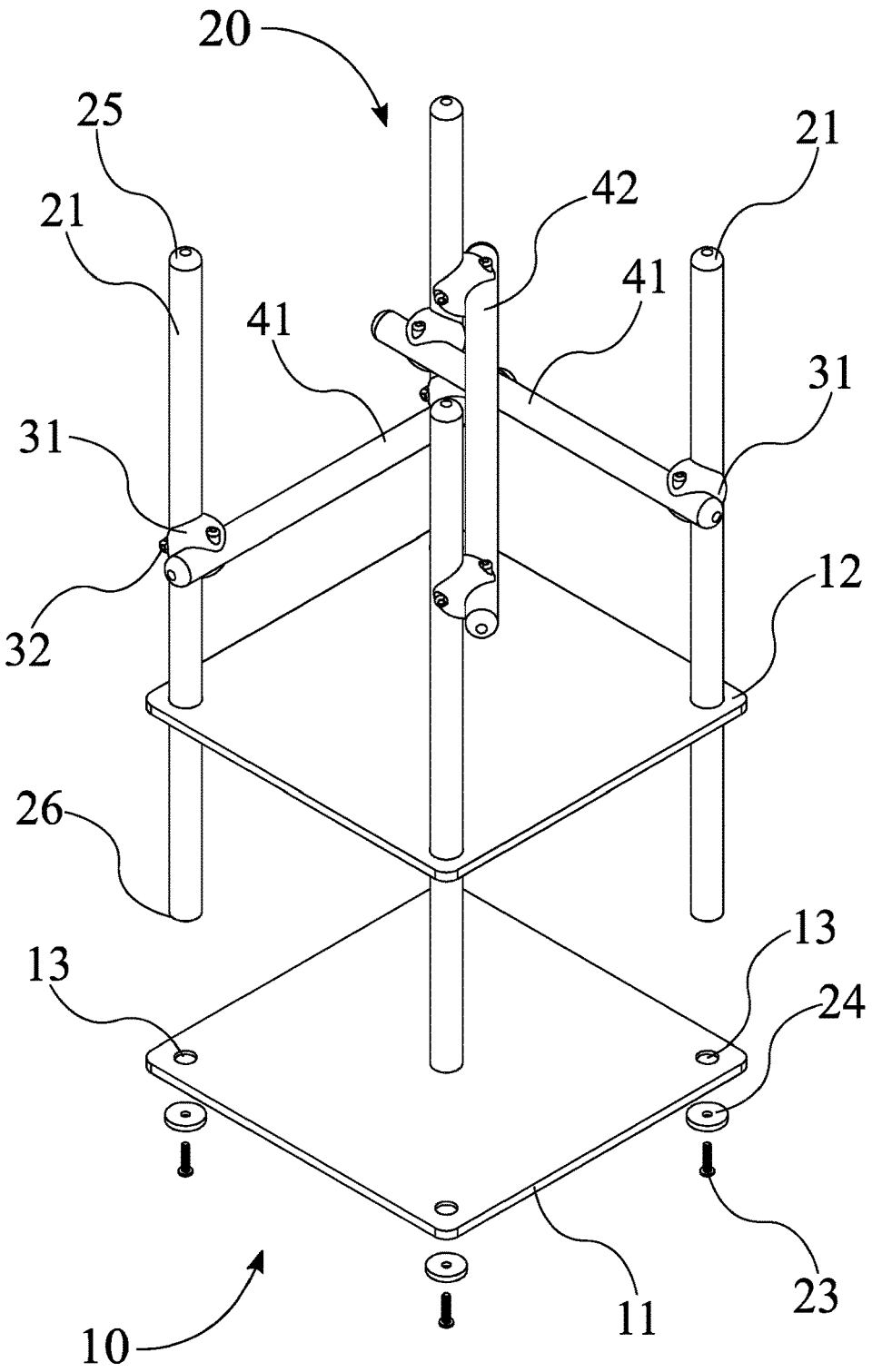
FIG. 2 is an exploded perspective view of the present invention where the smaller diameter of the plurality of plate apertures is observed on the first plate. Further observed is the plurality of vertical rod fasteners and the optional washer concentric therewith.
Figure 3:
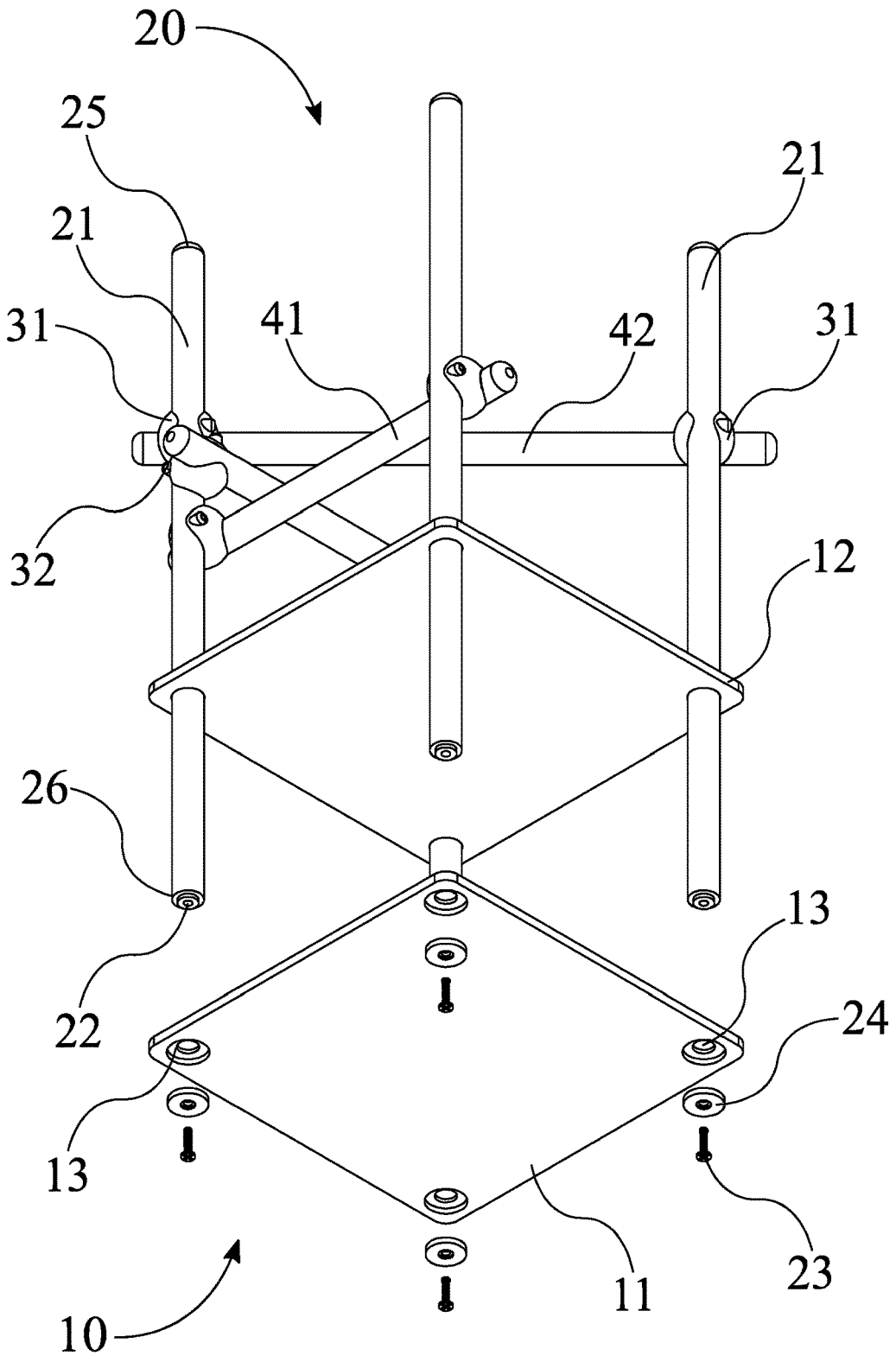
FIG. 3 is an exploded bottom perspective view of the apparatus thereof, where the fastener aperture of the plurality of vertical rods is observed on the underside thereof. Further observed are the two diameters of the plurality of plate apertures of the first plate.
Figure 4:
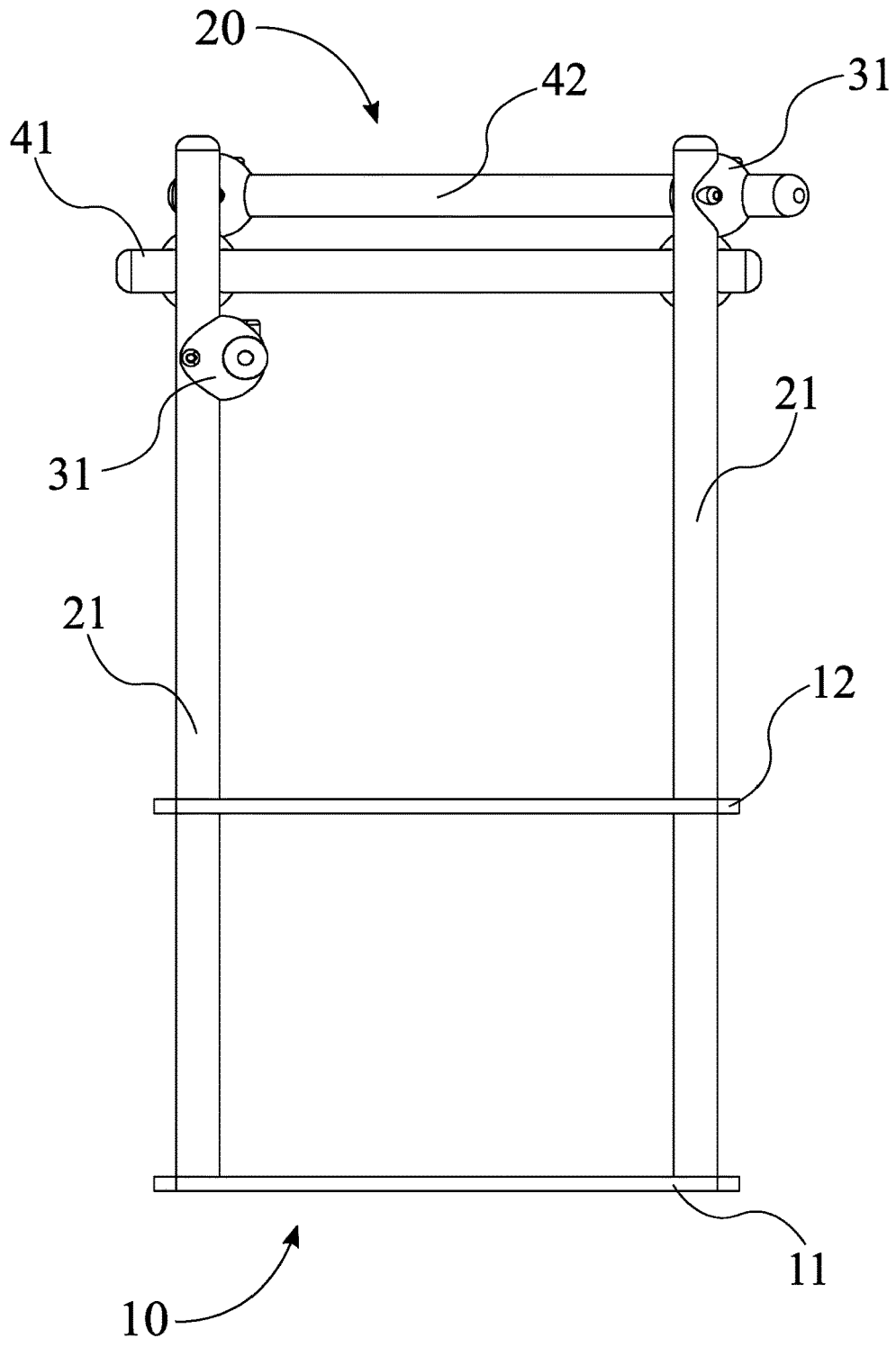
FIG. 4 is a front view of the apparatus thereof, where the clamp fastener is observed normal to the axis of the first aperture of the clamp the plurality of clamps. Further observed is the upper second plate parallel with the lower first plate.
Figure 5:
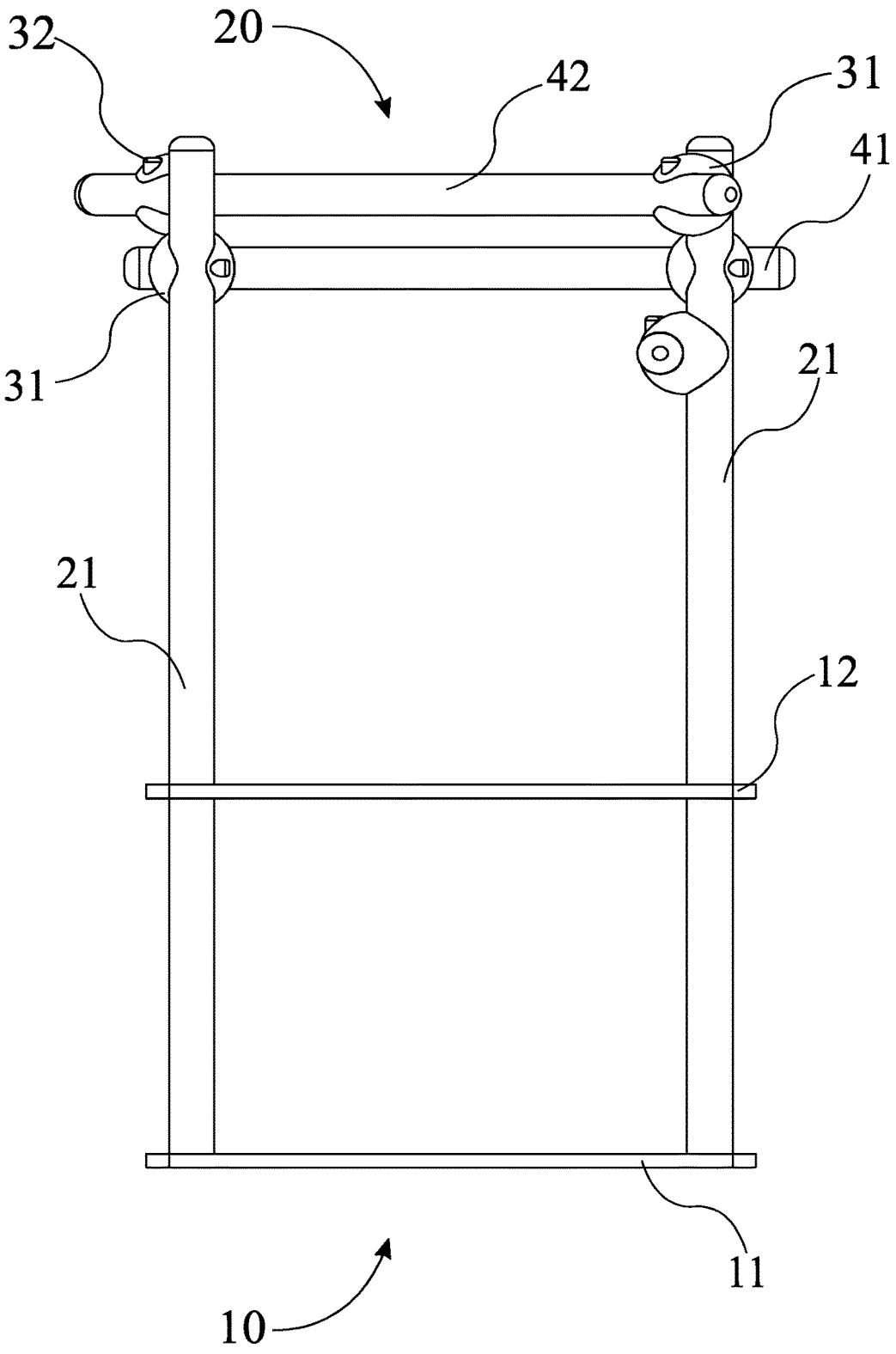
FIG. 5 is a rear view of the apparatus thereof, where the optional washer is observed on the underside of the first plate.
Figure 6:
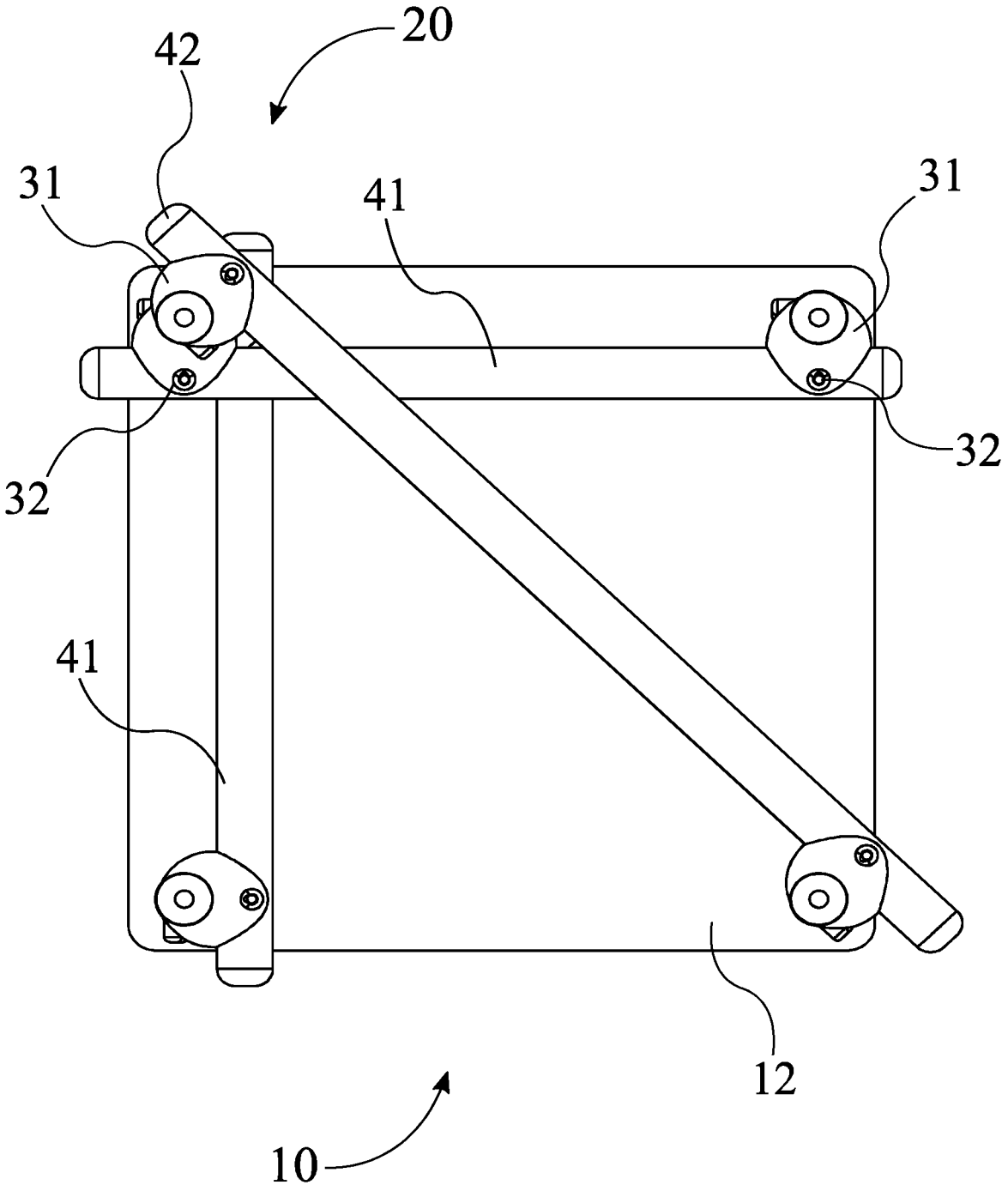
FIG. 6 is a top view of the apparatus thereof where the hypotenuse rod is observed in connection between two corner-located vertical rods of the plurality of vertical rods and passing over the center of the second plater. Further observed is the at least one adjacent rod that is connected to two vertical rods through a plurality of clamps, where the at least one adjacent rod is parallel with the edges of the second plate
Figure 7:
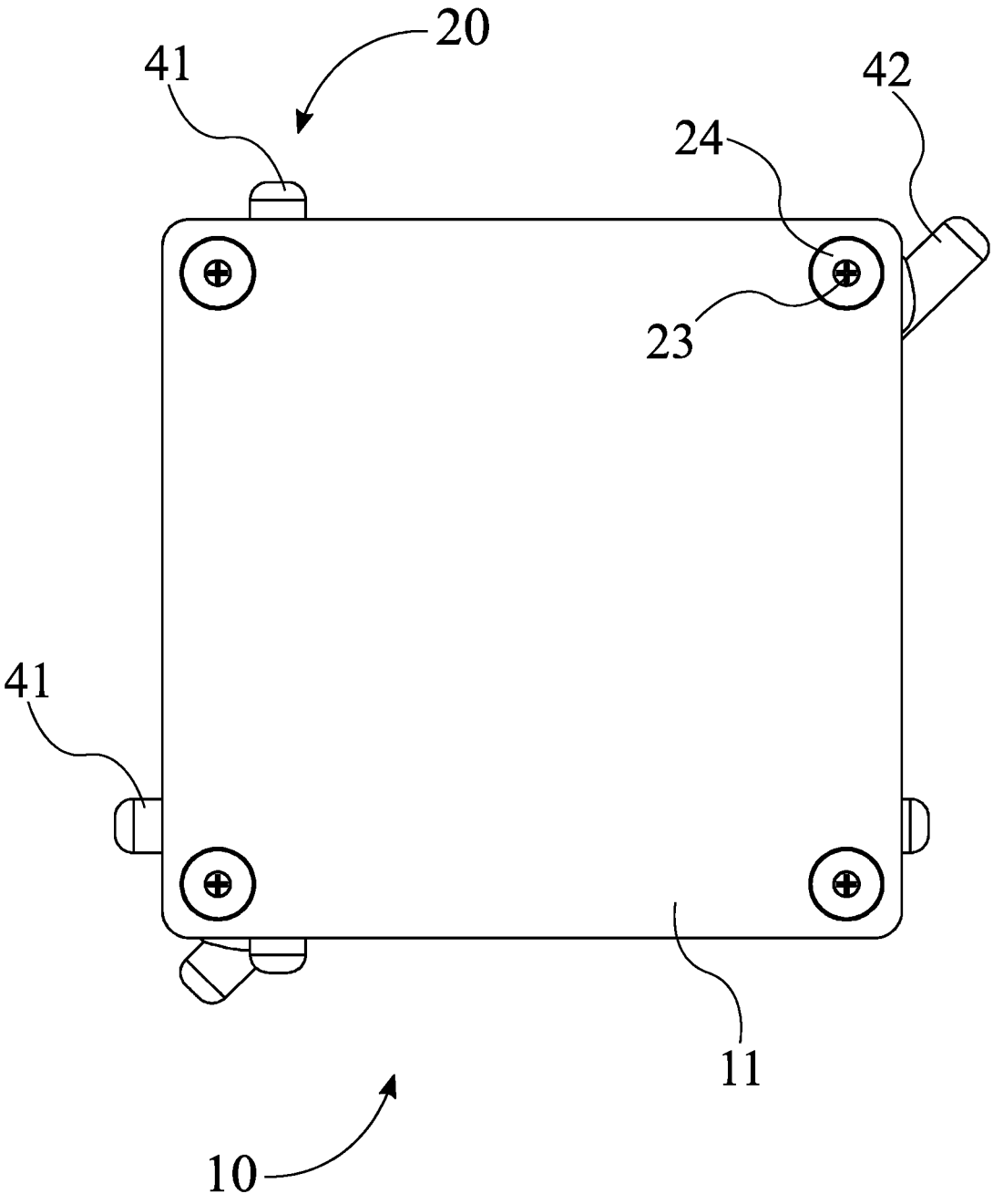
FIG. 7 is a bottom view of the apparatus thereof where the optional washer is observed within the plurality of plate apertures of the first plate and the plurality of vertical rod fasteners is observed concentric therewith.

As can be seen in FIG. 2 to FIG. 3, and FIG. 7, the plurality of plates 10 comprises a plurality of plate apertures 13 and the plurality of plate apertures 13 is distributed on each of the plurality of plates 10. The plurality of plates 10 is connected to the plurality of rods 20 through interengagement therewith. More specifically, the plurality of plates 10 preferably comprises the first 11 and second plate 12 in the exemplified embodiment. However, the plurality of plates 10 may comprise additional counts of plates such as a third plate and beyond. Additionally, the plurality of plates 10 preferably is kept parallel to one another and horizontally coincident and congruent with adjacent individual plates. Further, the plurality of plates 10 preferably comprises a rectilinear planar geometry. Although alternative geometry may be used including, but not limited to, curvilinear, trilinear, polygonal, organic, etc. The first plate 11 is disposed at the bottom of the assembly. Additionally, the first plate 11 is located beneath the second plate 12 and comprises a congruent geometry therewith. Further, the first plate 11 is oriented with the planar surface thereof normal to the axis of the plurality of vertical rods 21. Thus, the first plate 11 forms the base that accommodates the plurality of rods 20 thereon through the plurality of plate apertures 13. Bored normal through the plurality of plates 10 and preferably arranged horizontally coincident between the first plate 11 and the second plate 12, the plurality of plate aperture 13 of the first plate 11 shares a collinear center point of the aperture thereof with the center point of the individual plate aperture of the second plate 12. The plurality of plate apertures 13 preferably comprises two subsets where the plurality of plate apertures 13 of the second plate 12 comprises a larger diameter than those of the first plate 11. The plurality of plate apertures 13 on the second plate 12 permits vertical linear translation along the plurality of vertical rods 21, while the plurality of plate apertures 13 on the first plate 11 preferably comprises a smaller diameter than those of the second plate 12. The plurality of plate apertures 13 of the first plate 11 accommodates the bottom of the plurality of vertical rods 21, the washer 24 and fastener 23 of each of the plurality of vertical rods 21. Further, the plurality of plate apertures 13 of the first plate 11 comprises two diameters in the exemplified embodiment. The upper lesser diameter accommodates the bottom of the individual of the plurality of vertical rods 21 therein. The lower greater diameter of the individual of the plurality of plate apertures 13 accommodates the washer 24 therein. In the exemplified embodiment, the plurality of plate apertures 13 preferably comprises a count of four that accommodates up to an equivalent count of the plurality of vertical rods 21. The plurality of plate apertures 13 is preferably disposed in the corners of the plurality of plates 10. However, the plurality of plate apertures 13 may be located near the edge's midpoint of the first plate 11 and second plate 12 or other clusters that mitigate the rotation of the second plate 12 relative to the first plate 11. Further, the plurality of plate apertures 13 may comprise a count as few as two for the first plate 11 and the second plate 12 individually, or a count greater than four.

As can be seen in FIG. 1 to FIG. 11, the second plate 12 of the plurality of plates 10 is located above the first plate 11 and horizontally coincident therewith. The second plate 12 comprises the plurality of apertures 13 further horizontally coincident with those of the first plate 11. Thus, the second plate 12 may translate vertically up and down. Additionally, the second plate 12 is located preferably beneath the plurality of horizontal rods 41. The second plate 12 may rest atop an extraneous appliance including, but not limited to, a jack, a block, or a locking mechanism that imparts a compressive force through the second plate 12 onto the plurality of vertical rods 21. Preferably, the second plate 12 comprises a congruent geometry, similar to the first plate 11, however, the second plate 12 may possess disparate geometry or proportions therewith. In alternative embodiments, the second plate 12 shares at least two vertical rods of the plurality of vertical rods 21 with the first plate 11.

As can be seen in FIG. 8 to FIG. 11, in alternative embodiments of the present invention, the second plate 12 of the plurality of plates 10 may be detachably attached to at least one of the plurality of vertical rods 21 through at least one of the plurality of clamps 31. Additionally, the at least one of the plurality of vertical rods 21 comprises a through hole 29, which is interiorly positioned on the at least one of the plurality of vertical rods 21. Additionally, the through hole 29 is positioned parallel to the second plate 12 of the plurality of plates 10, Further, one of the plurality of horizontal rods 41 is colinearly aligned with and passes through the through hole 29.

Figure 8:
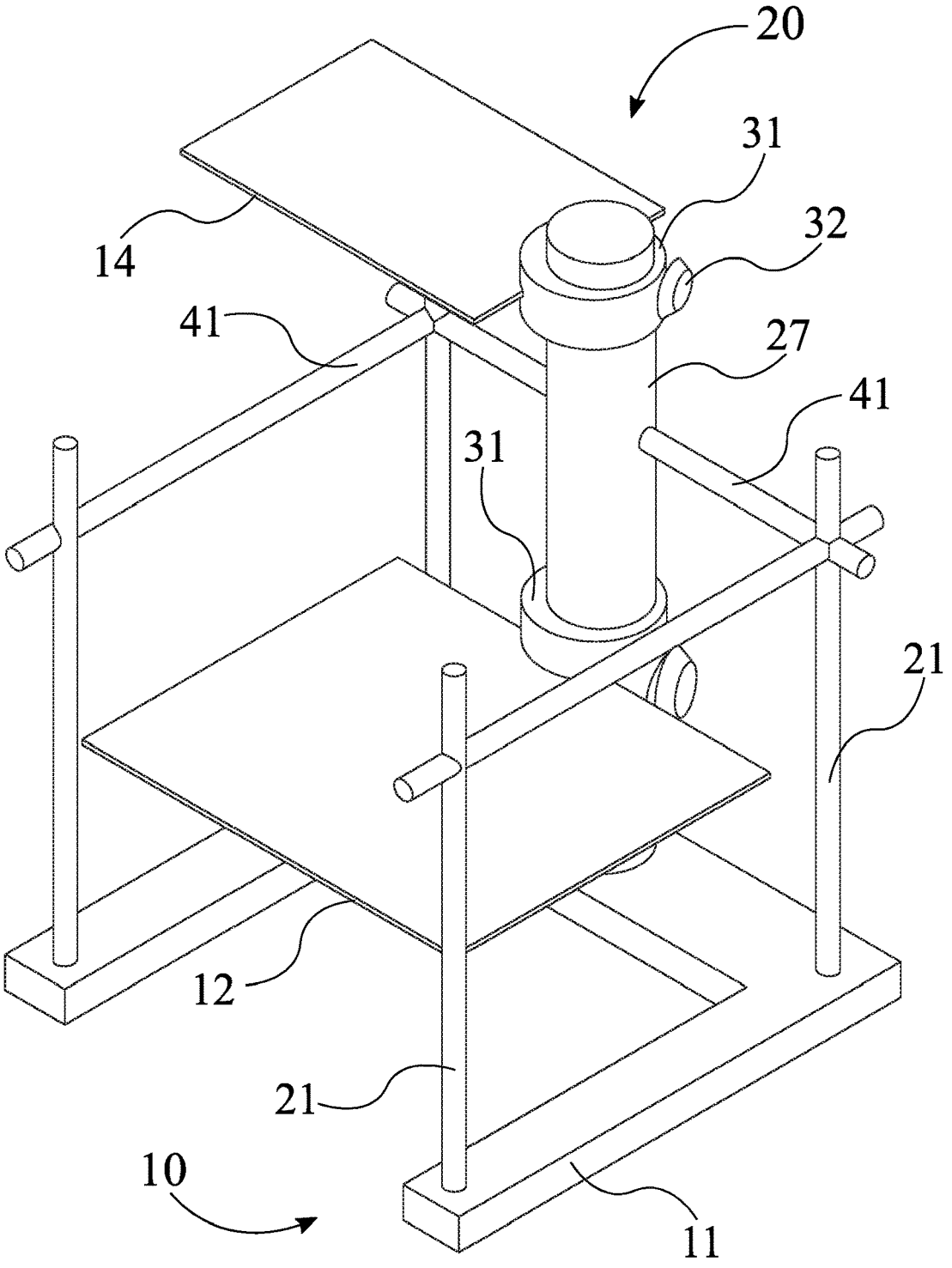
FIG. 8 is a perspective view of an alternative embodiment of the present invention where the plurality of vertical rods comprises a center rod. Further observed is the plurality of plates comprising at least one additional plate.
Figure 9:
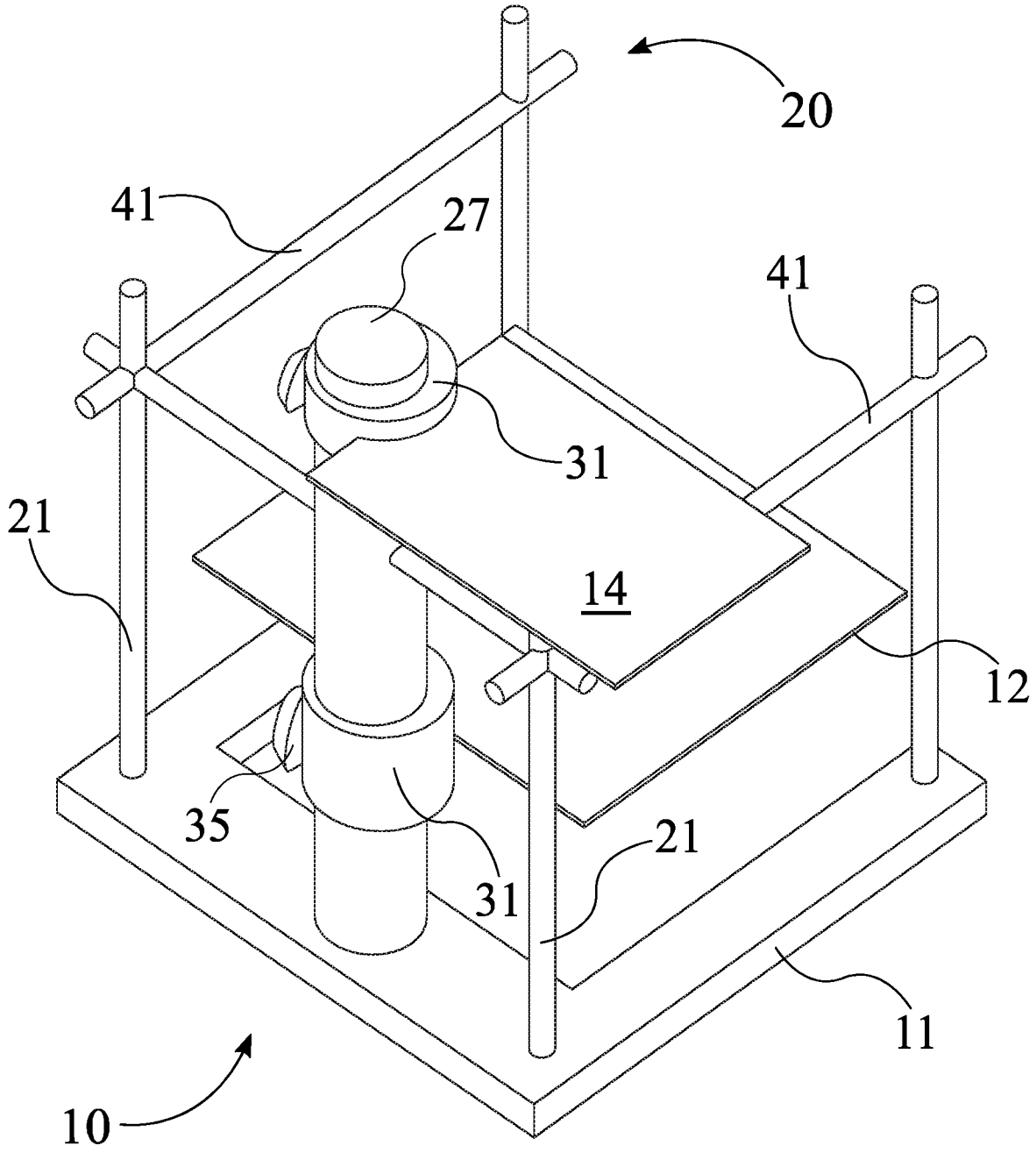
FIG. 9 is a back perspective view of an alternative embodiment of the present invention where the plurality of vertical rods comprises a center rod. Further observed is the plurality of plates comprising at least one additional plate.

As can be seen in FIG. 8 and FIG. 9, in alternative embodiments of the present invention, the plurality of plates 10 comprises the at least one additional plate 14. The at least one additional plate 14 is detachably attached to at least one of the plurality of vertical rods 21 and movably positioned above the second plate 12.

As can be seen in FIG. 1 to FIG. 11, the plurality of rods 20 of the present invention is inter-engaged with the plurality of plates 10. The plurality of rods 20 preferably comprises two subsets consisting of the plurality of vertical rods 21 and the plurality of horizontal rods 41. Additionally, the plurality of rods 20 permits linearly vertical translation between the plurality of plates 10 and further accommodates the placement of extraneous rigging. The plurality of rods 20 further preferably comprises a single rigid material including, but not limited to, metal, plastic, composite, wood, and so on. The plurality of rods 20 may comprise disparate diameters between the two subsets. The plurality of rods 20 is further preferably modularly assignable to the assembly through the plurality of vertical rods 21 and the plurality of clamps 31.

As can be seen in FIG. 1 to FIG. 6, and FIG. 8 to FIG. 11, the plurality of horizontal rods 41 of the plurality of rods 20 is disposed above the second plate 12. Specifically, the plurality of horizontal rods is preferably perpendicular to the plurality of vertical rods 21. The plurality of horizontal rods 41 may permit the mounting of extraneous rigging thereon. The extraneous rigging may comprise, but is not limited to, grips, rods, bars, fasteners, magnifying glasses, and so on. The plurality of horizontal rods 41 comprises at least one hypotenuse rod 42 and at least one adjacent rod 43. The at least one hypotenuse rod 42 is detachably attached to two opposing rods of the plurality of vertical rods 21 using two clamps of the plurality of clamps 31. The hypotenuse rod 42 enables attachment of extraneous riggings and equipment to the stand apparatus of the present invention. Being connected between two corner-opposing vertical rods of the plurality of vertical rods 21 in the exemplified embodiment, the at least one hypotenuse rod 42 spans over the center of the second plate 12 or near thereof. The at least one hypotenuse rod 42 permits the placement of extraneous rigging that is directly situated over any extraneous equipment or work articles such as beakers, models, and so on. Further, the at least one hypotenuse 42 is secured to the plurality of vertical rods 21 through two clamps of the plurality of clamps 31. Spanning between two vertical rods of the plurality of vertical rods 21 in the exemplified embodiment, the at least one adjacent rod 43 is preferably parallel with the edge of the second plate 12 disposed between the respective vertical rods. Specifically, the at least one adjacent rod 43 is detachably attached to two adjacent rods of the plurality of vertical rods 21 using two clamps of the plurality of clamps 31. The at least one adjacent rod 43 is positioned parallel with the edge of the second plate 12 of the plurality of plates 10. The at least one adjacent rod 43 enables attachment of extraneous riggings and equipment to the present invention. As can be seen in FIG. 1 to FIG. 6, and FIG. 8 to FIG. 11, each of the plurality of clamps 31 comprises a plurality of clamp fasteners 32, a first aperture 33, and second aperture 34. More specifically, the first aperture 33 and the second aperture 34 are laterally distributed on opposing sides of each of the plurality of clamps 31. Disposed arbitrarily along the plurality of vertical rods 21 in an arbitrary count is the plurality of clamps 31. The plurality of clamps 31 mounts on the plurality of vertical rods 21 through the plurality of clamp fasteners 32, thereby permitting the coupling with an individual rod of the plurality of horizontal rods 41. The individual vertical rod of the plurality of vertical rods 21 is housed within the first aperture 33 and the individual horizontal rod of the plurality of horizontal rods 41 is housed in the second aperture 34 of the individual clamp of the plurality of clamps 31. Thus, the plurality of clamps 31 facilitate the modular assembly of a cage above the plurality of plates 10.

Figure 10:
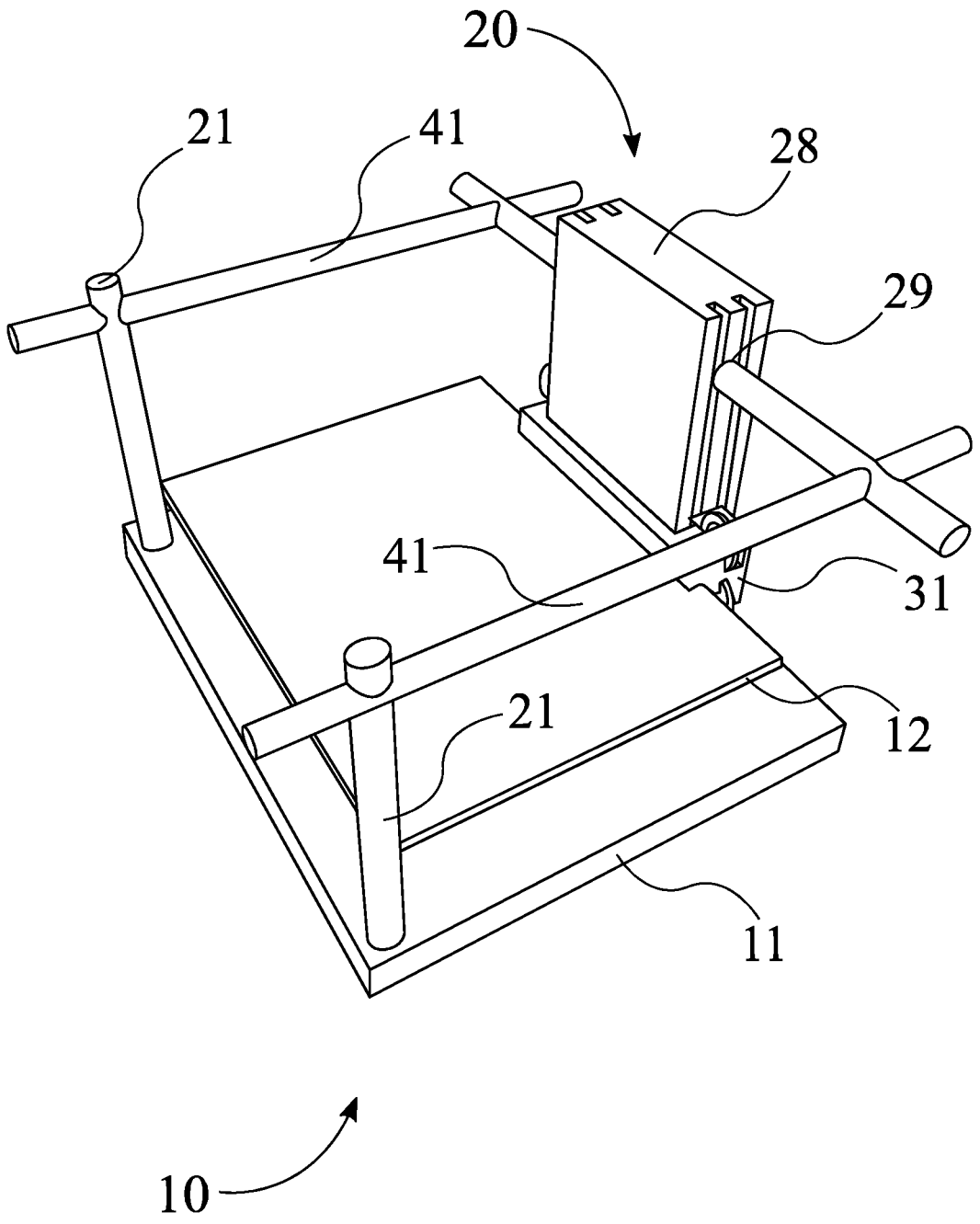
FIG. 10 is a perspective view of an alternative embodiment of the present invention where the plurality of vertical rods comprises a support block.
Figure 11:
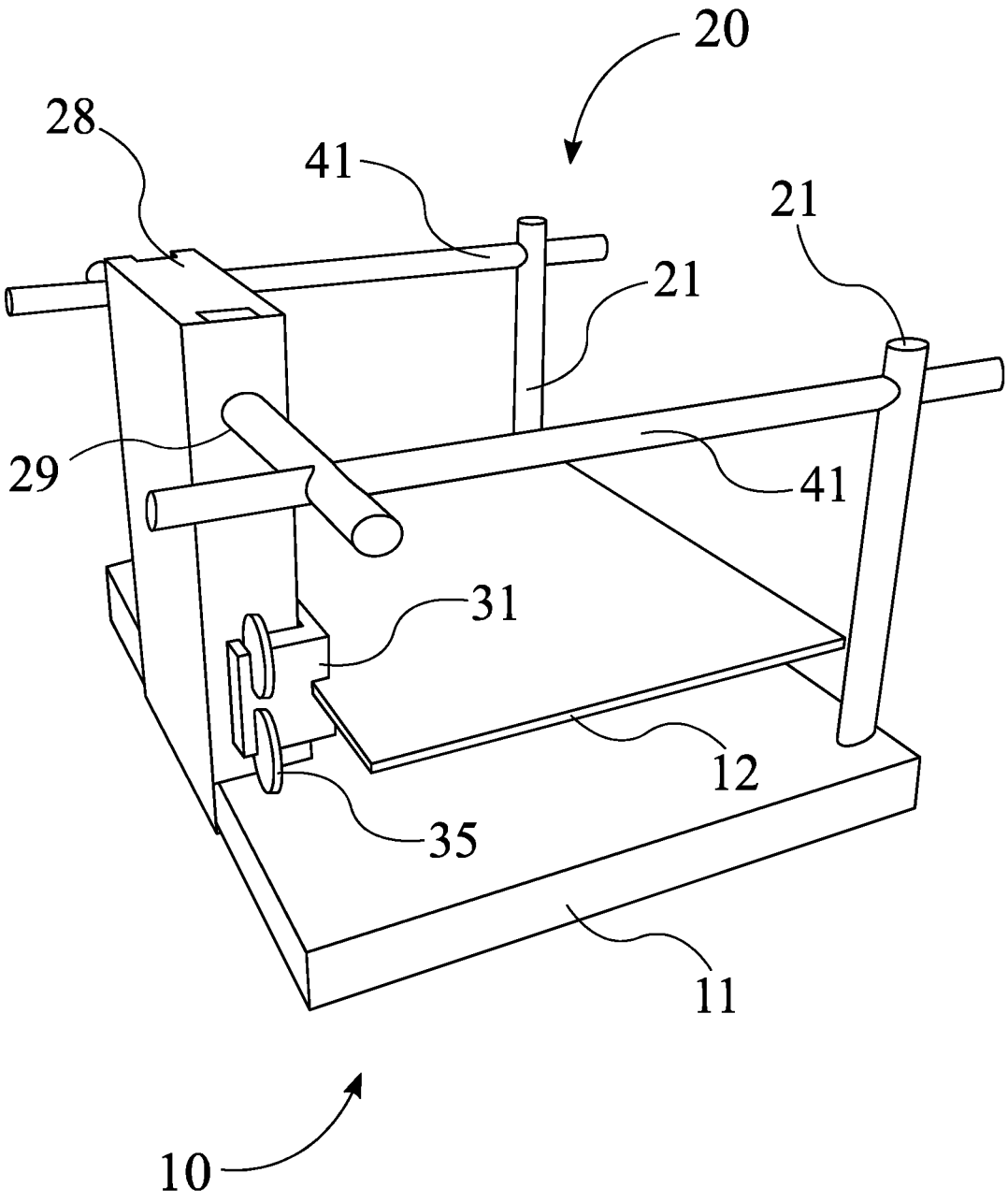
FIG. 11 is a back perspective view of an alternative embodiment of the present invention where the plurality of vertical rods comprises a support block.

The first aperture 33 is positioned perpendicular to the second aperture 34. Additionally, each of the horizontal rods 41 is detachably attached to one of the plurality of vertical rods 21 through the first aperture 33 and second aperture 34 of one of the plurality of clamps 31 using the plurality of clamp fasteners 32. Corresponding to the first aperture 33 and second aperture 34 of the each of the plurality of clamps 31 is the plurality of clamp fasteners 32. The plurality of clamp fasteners 32 may be tightened to lock the individual rod of the plurality of vertical rods 21 and the individual rods 21 of the plurality of horizontal rods 41 that the individual clamp of the plurality of clamp fasteners 32 is in connection to. As can be seen in FIG. 10 to FIG. 11, the plurality of clamp fasteners 32 comprises a wing fastener 35.

As can be seen in FIG. 2 to FIG. 3, and FIG. 7, the plurality of vertical rods 21 is colinearly aligned with the plurality of plate apertures 13. The axis of the plurality of vertical rods 21 is normal to the planar surfaces of the plurality of plates 10. The plurality of vertical rods 21 is mounted to the plurality of apertures 13 of the first plate 11 and slotted within the plurality of apertures 13 of the second plate 13, thereby permitting the second plate 12 to linearly translate vertically up and down along the plurality of vertical rods 21. Further, the plurality of vertical rods 21 may include, but is not limited to, a count equal to or greater than the plurality of apertures 13 of the second plate 12. Preferably, the plurality of vertical rods 21 comprises a curvilinear cross section to complement the plurality of plate apertures 13. However, the plurality of vertical rods 21 may comprise a cross section disparate thereof that is dictated by the cross section of the plurality of plate apertures 13 including, but not limited to, trilinear, rectilinear, polygonal, and so on. Each of the plurality of vertical rods 21 comprises the fastener 23, the washer 24, a first end 25 and a second end 26. More specifically, the second end 26 is terminally positioned within one of the plurality of plate apertures 13 of first plate 11 opposite the first end 25. Additionally, the second end 26 comprises a fastener aperture 22 which is terminally and colinearly positioned on the second end 26 of each of the plurality of vertical rods 21. The fastener 23 is engaged with the fastener aperture 22 and the washer 24 is positioned between the fastener 23 and the first plate 11. Each of the plurality of vertical rods 21 is normally attached to the first plate 11 through the fastener 23 and the washer 24. Further, each of the plurality of vertical rods 21 is colinearly positioned within each of the plate apertures 13 of the second plate 12 and positioned perpendicular to the second plate 12. The fastener aperture 22 of each of the plurality of vertical rod 21 is disposed at the bottom of the individual rod of the plurality of vertical rods 21. The fastener aperture 22 is collinear with the axis of the individual rod. Additionally, the fastener aperture 22 engages with the fastener 23 of the plurality of vertical rods 21 and the engagement therewith arrests the individual vertical rod with the first plate 11. The fastener 23 of the plurality of vertical rods 21 is engaged with the fastener aperture 22 of each of the plurality of vertical rods 21. The fastener 23 is equivalent in count to the plurality of vertical rods 21. Additionally, the fastener 23 preferably secures down the washer 24 individually in the exemplified embodiment, wherein the washer 24 restricts the removal of the individual rod of the plurality of vertical rods 21 from the first plate 11. The fastener 23 preferably comprises a conventional fastener; however other means of fastening may be employed including, but not limited to, snap fitting, tolerance fitting, self-locating geometry, rotational locking, and so on. The washer 24 is accommodated within the plurality of plate apertures 13 of the first plate 11 and mounted with the fastener 23 of each of the plurality of vertical rods 21. The washer 24 comprises an annular planar body that further comprises an interior diameter marginally larger than the fastener 23 in the exemplified embodiment. The interior diameter is smaller than the head of the fastener 23 and thus allowing the washer 24 to mitigate the vertical translation of the individual rod of the plurality of vertical rods 21 relevant to the first plate 11. The washer 24 may be substituted by a washer of alternate geometry such as annular rectilinear/trilinear geometry; or substituted with a retaining means that complements the fastener 23 such as snap fitting or rotational locking complements.

As can be seen in FIG. 8 to FIG. 9, in an alternative embodiment of the present invention, the at least one of the plurality of vertical rods 21 is a center rod 27.

As can be seen in FIG. 10 to FIG. 11, in another alternative embodiment of the present invention, the at least one of the plurality of vertical rods 21 is a support block.

Although the invention has been explained in relation to its preferred embodiment, it is to be understood that many other possible modifications and variations can be made without departing from the spirit and scope of the invention as hereinafter claimed.

What is claimed is:

1. A stand apparatus for conducting laboratory experiments comprising:

a plurality of plates;

a plurality of rods;

the plurality of plates consisting of a first plate and a second plate;

the plurality of rods comprising a plurality of vertical rods, a plurality of clamps, and a plurality of horizontal rods;

the plurality of vertical rods being terminally mounted to the first plate of the plurality of plates;

the plurality of vertical rods being positioned perpendicular to the first plate;

each of the plurality of horizontal rods being detachably attached to one or more of the plurality of vertical rods through the plurality of clamps;

the plurality of horizontal rods being positioned perpendicular to the plurality of vertical rods;

the second plate being movably attached to at least one of the plurality of vertical rods;

each of the plurality of clamps comprising a plurality of clamp fasteners; a first aperture, and second aperture;

the first aperture and the second aperture being laterally distributed on opposing sides of each of the plurality of clamps; and each of the horizontal rods being detachably attached to one or more of the plurality of vertical rods through one or more of the plurality of clamps using one or more of the plurality of clamp fasteners.

2. The stand apparatus for conducting laboratory experiments as claimed in claim 1, wherein:

the plurality of plates comprises at least one additional plate;

the at least one additional plate is detachably attached to at least one of the plurality of vertical rods; and the at least one additional plate being movably positioned above the second plate.

3. The stand apparatus for conducting laboratory experiments as claimed in claim 1, wherein:

the plurality of horizontal rods comprises at least one hypotenuse rod;

the at least one hypotenuse rod is detachably attached to two opposing rods of the plurality of vertical rods using two clamps of the plurality of clamps; and the at least one hypotenuse rod enables attachment of extraneous riggings and equipment.

4. The stand apparatus for conducting laboratory experiments as claimed in claim 1, wherein:

the plurality of horizontal rods comprises at least one adjacent rod;

the at least one adjacent rod is detachably attached to two adjacent rods of the plurality of vertical rods using two clamps of the plurality of clamps;

the at least one adjacent rod is positioned parallel with one of the edges of the second plate of the plurality of plates; and wherein the at least one adjacent rod enables attachment of extraneous riggings and equipment.

5. The stand apparatus for conducting laboratory experiments as claimed in claim 1, wherein:

the plurality of plates comprises a plurality of plate apertures; and one or more of the plurality of plate apertures are distributed on each of the plurality of plates.

6. The stand apparatus for conducting laboratory experiments as claimed in claim 1, wherein the second plate of the plurality of plates is detachably attached to at least one of the plurality of vertical rods through at least one of the plurality of clamps.

7. The stand apparatus for conducting laboratory experiments as claimed in claim 6, wherein:

the at least one of the plurality of vertical rods comprises a through hole;

the through hole is interiorly positioned on the at least one of the plurality of vertical rods;

the through hole is positioned parallel to the second plate of the plurality of plates; and one of the plurality of horizontal rods is colinearly aligned with and passes through the through hole.

8. The stand apparatus for conducting laboratory experiments as claimed in claim 1, wherein the plurality of clamp fasteners comprises a wing fastener.

9. A stand apparatus for conducting laboratory experiments as comprising:

a plurality of plates;

a plurality of rods;

the plurality of plates comprising a first plate and a second plate;

the plurality of rods comprising a plurality of vertical rods, a plurality of clamps, and a plurality of horizontal rods;

the plurality of vertical rods being terminally mounted to the first plate of the plurality of plates;

the plurality of vertical rods being positioned perpendicular to the first plate;

each of the plurality of horizontal rods being detachably attached to one or more of the plurality of vertical rods through the plurality of clamps;

the plurality of horizontal rods being positioned perpendicular to the plurality of vertical rods;

the second plate being movably attached to at least one of the plurality of vertical rods;

the plurality of plates comprising a plurality of plate apertures;

one or more of the plurality of plate apertures being distributed on each of the plurality of plates;

each of the plurality of vertical rods comprising a fastener, a washer, a first end and a second end;

the second end being terminally positioned within one of the plurality of plate apertures of the first plate opposite the first end;

the second end comprising a fastener aperture;

the fastener aperture being terminally and colinearly positioned on the second end;

the fastener being engaged with the fastener aperture;

the washer being positioned between the fastener and the first plate; and each of the plurality of vertical rods being normally attached to the first plate through the fastener and the washer.

10. A stand apparatus for conducting laboratory experiments comprising:

a plurality of plates;

a plurality of rods;

the plurality of plates comprising a first plate and a second plate;

the plurality of rods comprising a plurality of vertical rods, a plurality of clamps, and a plurality of horizontal rods;

the plurality of vertical rods being terminally mounted to the first plate of the plurality of plates;

the plurality of vertical rods being positioned perpendicular to the first plate;

each of the plurality of horizontal rods being detachably attached to one or more of the plurality of vertical rods through the plurality of clamps;

the plurality of horizontal rods being positioned perpendicular to the plurality of vertical rods;

the second plate being movably attached to at least one of the plurality of vertical rods;

the plurality of plates comprising a plurality of plate apertures;

one or more of the plurality of plate apertures being distributed on each of the plurality of plates;

each of the plurality of vertical rods being colinearly positioned within one or more of the plate apertures of the second plate; and each of the plurality of vertical rods being positioned perpendicular to the second plate.

* * * * *